US005486662A

United States Patent [19]

Takiishi

[11] Patent Number: 5,486,662

[45] Date of Patent: Jan. 23, 1996

[54] FLEXIBLE CONNECTOR FOR A CIRCUIT INTERRUPTER

[75] Inventor: Antonio I. Takiishi, Coraopolis, Pa.

[73] Assignee: Eaton Corporation, Cleveland, Ohio

[21] Appl. No.: 93,287

[22] Filed: Jul. 16, 1993

[51] Int. Cl.[6] ..... H01H 9/00

[52] U.S. Cl. ..... 200/50 AA; 218/118

[58] Field of Search ..... 200/50 R–50 C, 200/144 R, 144 B; 218/1, 118, 120, 121, 140

[56] References Cited

U.S. PATENT DOCUMENTS 4,144,554 3/1979 Erickson ..... 361/355
4,376,235 3/1983 Milianowicz ..... 200/50 AA
4,384,179 5/1983 Milianowicz ..... 200/50 AA

FOREIGN PATENT DOCUMENTS 345136 9/1905 France ..... H01H 1/58

*Primary Examiner*—Kristine L. Kincaid
*Assistant Examiner*—Michael A. Friedhofer
*Attorney, Agent, or Firm*—Martin J. Moran

[57] ABSTRACT

A flexible connector for connecting a movable contact of an electrical switch to a fixed electrical terminal. The flexible connector is a stack of flexible sheets of a conducting material. The flexible connector is constructed such that it can accommodate the movement of the movable contact. A circuit interrupter system, such as a vacuum circuit interrupter, and metal clad switchgear are also provided.

3 Claims, 5 Drawing Sheets

FLEXIBLE CONNECTOR FOR A CIRCUIT INTERRUPTER

CROSS REFERENCE TO RELATED APPLICATIONS

This application is related to commonly owned, concurrently filed United States Patent Application entitled "DRIVE MECHANISM FOR A CIRCUIT INTERRUPTER" invented by George A. Hodkin, Trevor B. Marshall and David G. Roberts and designated by Ser. No. 08/093288 and United States Patent Application entitled "CRADLE ASSEMBLY FOR CIRCUIT INTERRUPTER" invented by George A. Hodkin, Trevor B. Marshall and David G. Roberts and designated by Ser. No. 08/093,298.

BACKGROUND OF THE INVENTION

This invention relates to a flexible connector for a circuit interrupter and more particularly to a flexible connector having a stack of flexible sheets of a conducting material for connection with the movable contact of a circuit interrupter.

Circuit breakers are useful for controlling and protecting electrical systems, apparatus and networks. A particular type of circuit breaker is a vacuum circuit interrupter apparatus which includes separable main contacts disposed in an insulated housing. Generally, one of the contacts is fixed relative to both the housing and to an external electrical conductor which is interconnected with the circuit to be controlled by the vacuum circuit interrupter. The other main contact is movable and usually comprises a cylindrical stem having the contact at one end thereof enclosed in a vacuum chamber and driving mechanism at the other end thereof external to the vacuum chamber.

Often the electrical interconnection between the circuit to be protected by the circuit interrupter and the movable contact is made on the cylindrical stem. Therefore, a need arises for channelling significant amounts of electrical current from a movable stem to a stationary electrical contact.

There have been several suggested prior art devices for transferring current from a movable contact to a fixed terminal. For example, U.S. Pat. Nos. 4,376,235 and 4,384,179 disclose a stiff flexible connector for a circuit breaker apparatus. A plurality of unitary, stiff, but flexible electrically conducting members are provided. The members are disposed in a horizontal position, but can move vertically due to a pleat in the member. Although the above design is in commercial use, it is sometimes not suitable for certain applications where reduced dimensional tolerances for the metal clad switchgear in which the interrupter are present, such as metal clad switchgear used in countries outside of the United States. Thus, it would be advantageous to provide a flexible, but stiff conducting member that can be used with a vacuum circuit interrupter and which provides other advantages over existing prior art designs.

SUMMARY OF THE INVENTION

In accordance with the invention, a flexible connector for connecting a movable contact of an electrical switch to a fixed electrical terminal is provided. The flexible connector is a stack of flexible sheets of a conducting material. The flexible connector is constructed such that it can accommodate the movement of the movable contact.

A circuit interrupter system, such as a vacuum circuit interrupter, is also provided. The circuit interrupter system comprises a circuit interrupter means including a fixed contact and a movable contact, a fixed electrical terminal and a flexible connector for connecting the movable contact with the fixed electrical terminal. The flexible connector is constructed in accordance with the invention, as disclosed above.

Finally, metal clad switchgear is also provided including a metal cabinet, terminals in the metal cabinet and a circuit interrupter made in accordance with invention.

BRIEF DESCRIPTION OF THE DRAWINGS

A full understanding of the invention can be gained from the following description of the preferred embodiment when read in conjunction with the accompanying drawings in which.

DETAILED DESCRIPTION

Figure 1:
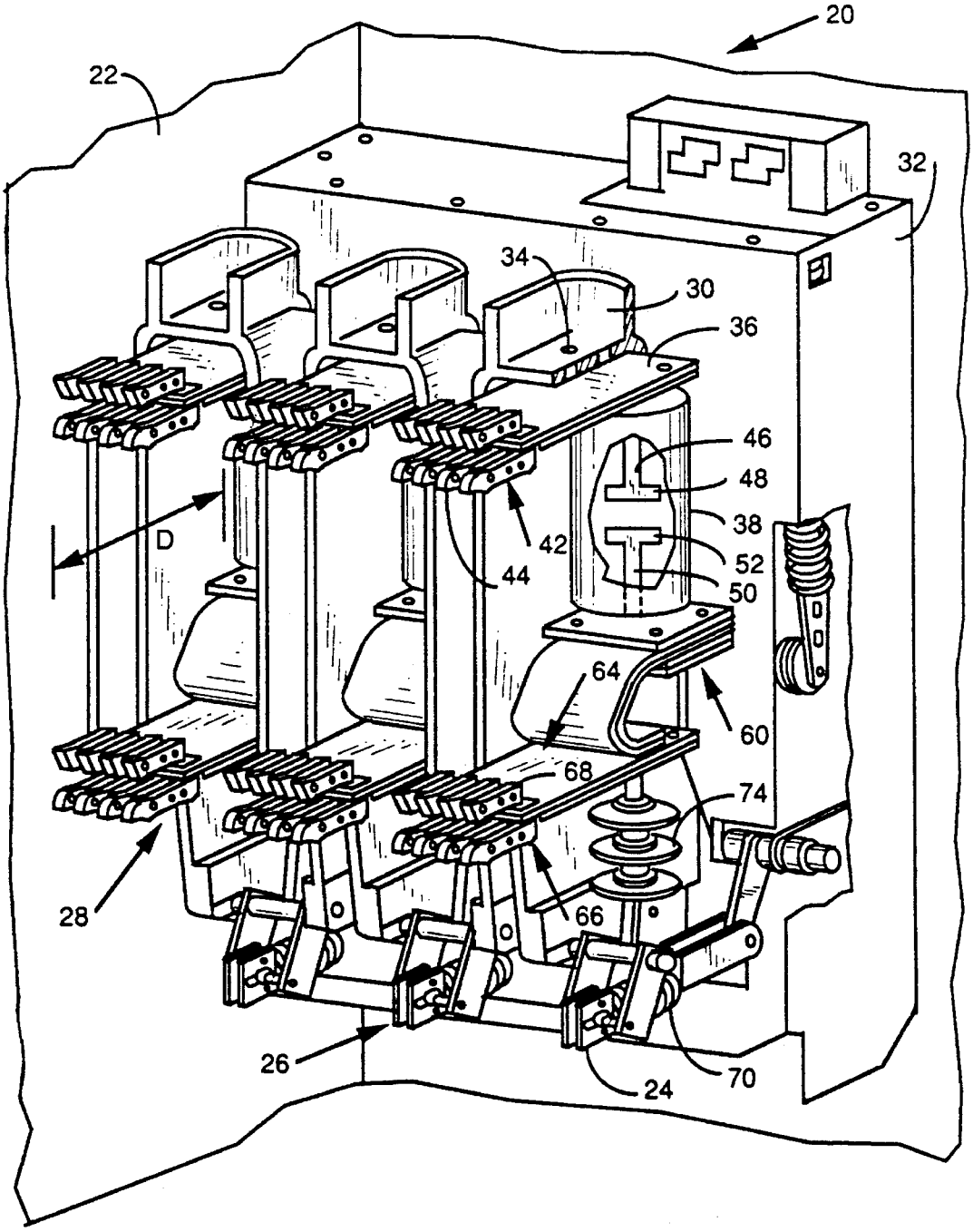
FIG. 1 is a perspective view, partially in section, showing a portion of metal clad switchgear having the vacuum circuit interrupter means of the invention.

Referring to FIG. 1, a portion of a metal clad switchgear system showing the circuit interrupter and flexible connector of the invention is shown. The metal clad switchgear system consists of a switchgear station 20 which includes a metal cabinet or enclosure 22 having disposed therein three vacuum circuit interrupters 24, 26 and 28, only one of which, vacuum circuit interrupter 24, will be explained in detail below.

Vacuum circuit interrupter 24 is mounted in a molded plastic enclosure 30 (partially cutaway in order to show the other parts of the vacuum circuit interrupter 24) which is in turn mounted to a frame housing 32. The vacuum circuit interrupter 24 is mounted in the enclosure 30 by means of cap head screws, only one of which, cap head screw 34 is shown in FIG. 1.

The vacuum circuit interrupter 24 consists of a first terminal 36 which is electrically connected to a vacuum bottle 38 by a plate 40 (FIG. 2) disposed on the top surface of the bottle 38. The first terminal 36 has a free end 42 consisting of a series of electrical contacts 44. The bottle 38 is of conventional design and as can best be seen in FIG. 1, the vacuum bottle 38 contains a top fixed stem 46 which terminates in an enlarged diameter fixed contact 48 and a bottom movable stem 50 which terminates in an enlarged diameter movable contact 52. The bottom movable stem 50 extends beyond the bottle 38 and is engaged by the flexible connector means 60 of the invention, which will be described in detail below. It will be appreciated that the flexible connector 60 has a length greater than the shortest distance between the point where the flexible connector contacts the movable stem and the point where the flexible connector contacts the second terminal. This will, of course, facilitate movement of the bottom movable stem 50. It will be further appreciated that because of the configuration of the flexible connector 60, the flexible connector means 60 does not need the amount of horizontal clearance (indicated by distance D) that prior devices that rely on horizontal displacement require.

The flexible connector means 60 electrically connects the movable contact 52 with the second terminal 64, which also terminates a free end 66 which has a series of electrical contacts 68. It will be appreciated that current flows into the first terminal 36, to the fixed top stem 46 and fixed top contact 48. When the bottom movable stem 50 is moved so that the bottom movable contact 52 touches the fixed top contact 48, electric current will flow through the bottom movable contact 52 and the bottom movable stem 50 and into the second terminal 64. When contact between the top fixed contact 48 and the bottom contact 52 is broken, current will no longer flow from the first terminal 36 out to the second terminal 64.

The bottom movable stem 50 is moved by means of a drive mechanism 70, such as the drive mechanism described in commonly owned, concurrently filed United States Patent Application entitled "DRIVE MECHANISM FOR A CIRCUIT INTERRUPTER". Drive mechanism 70 and its operation will not be described in detail, however it will be appreciated that the bottom movable stem 50 is mechanically connected to the drive mechanism 70 by drive insulator 74 shown in FIG. 1.

Figure 2:
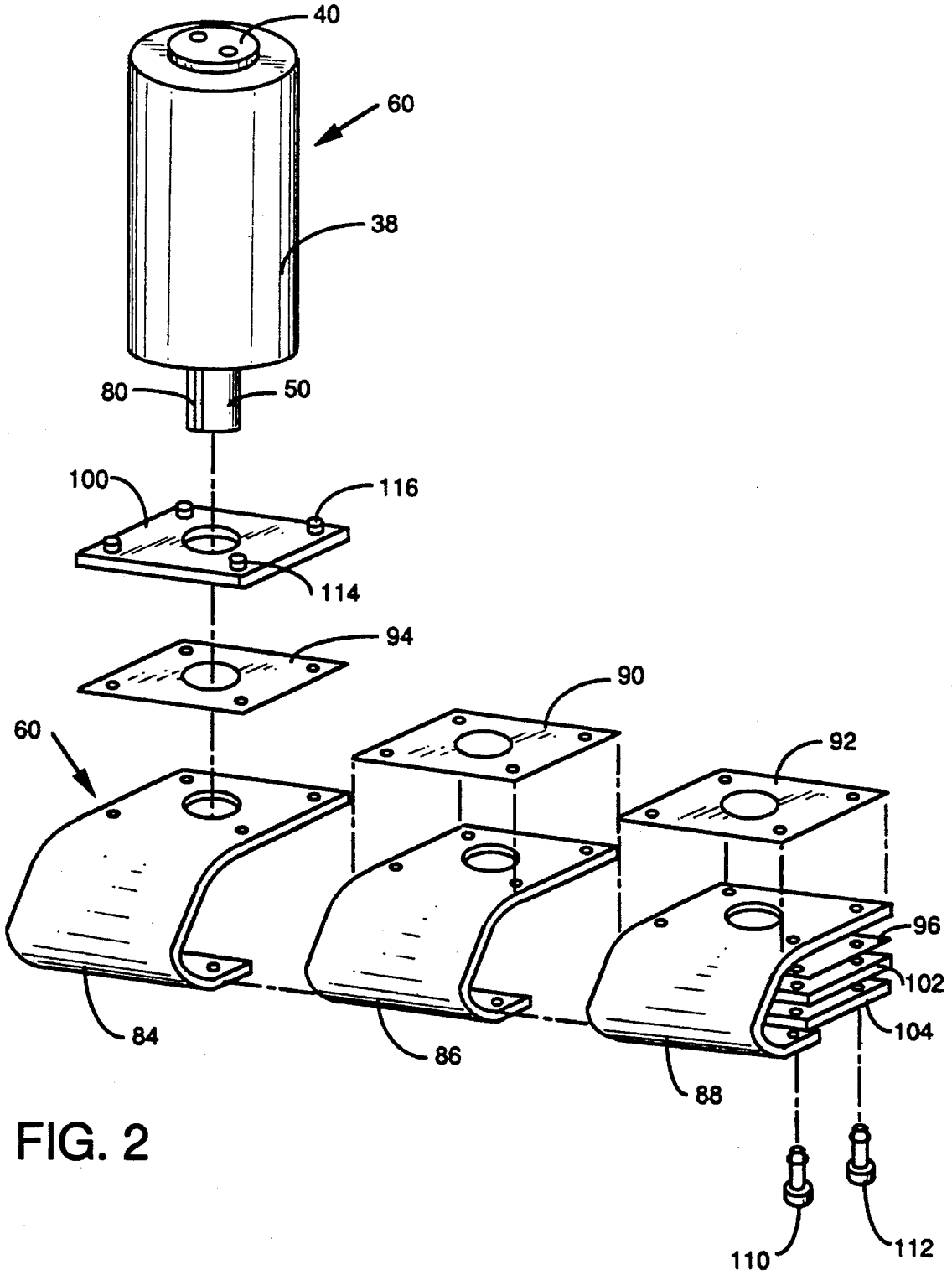
FIG. 2 is an exploded perspective view, partially in section, of the vacuum circuit interrupter means of the invention.
Figure 3:
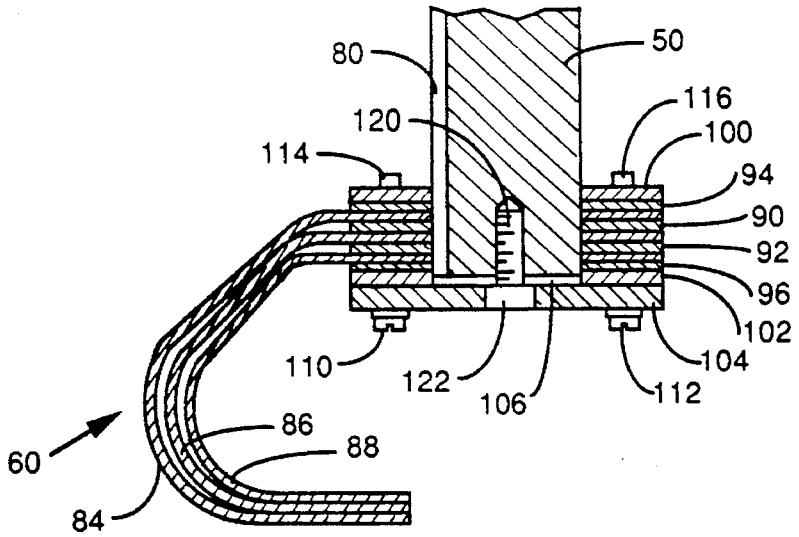
FIG. 3 is a detailed vertical section showing a flexible connector in accordance with the invention secured to the movable contact of the vacuum circuit interrupter means.

Referring now to FIGS. 2 and 3, the vacuum circuit interrupter will be explained in detail. FIG. 2 shows the bottle 38 and the bottom movable stem 50. The bottom movable stem 50 includes a groove 80 therein which is complementary to a guide (not shown) in the vacuum bottle 38. The guide and the groove 80 act to resist undesired rotation of the bottom movable stem 50. The vacuum circuit interrupter 24 includes the flexible connector means 60 of the invention. The flexible connector means 60 consists of three separate flexible connectors 84, 86 and 88 which have interleaved therebetween two intermediate contact plates 90, 92 and which are sandwiched by a top contact plate 94 and a bottom contact plate 96. The interleaved contact plates and flexible connectors are sandwiched by clamping plates, which consists of a top clamping plate 100 and two bottom clamping plates consisting of a base plate 102 and a bottom plate 104. A slight gap 106 (FIG. 3) is maintained between the bottom of the movable stem 50 and the bottom plate 104 in order to assure sufficient contact of the various elements of the flexible connector 84. The flexible connector means 60 is clamped together by four fastening means, only two of which clinch nuts 114 and 116 and respective bolts 110 and 112, are shown in FIG. 3. FIG. 3 also shows that the bottom movable stem 50 defines a threaded tap drill 120 and that the bottom most clamping plate 104 also defines an opening 122. The threaded tap drill 120 will receive a complementary threaded rod (not shown) that will connect the bottom movable stem 50 to the drive mechanism 70.

The flexible connectors 84, 86, and 88 are similarly constructed and only flexible connector 84 will be described in detail in FIGS. 4 and 5.

Figure 4:
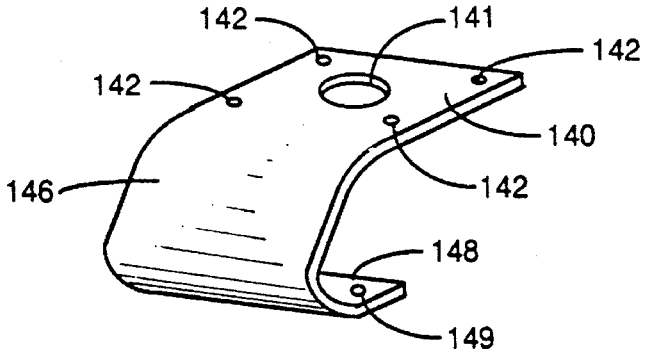
FIG. 4 is a perspective view of one flexible connector made in accordance with the invention.
Figure 5:
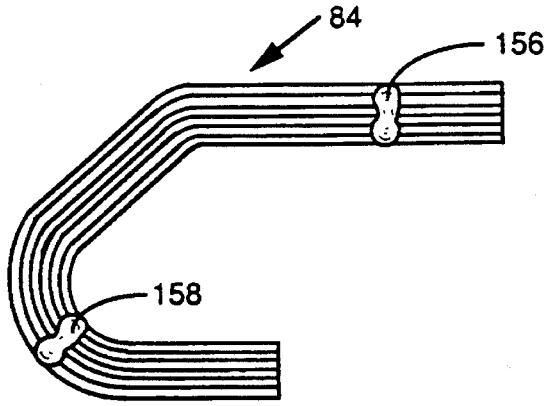
FIG. 5 is a detailed side view of a portion of the flexible connector of FIG. 4 showing the spot welds which join together the stack of flexible sheets that comprise the flexible connector.

As can be seen in FIGS. 4 and 5, the flexible connector 84 is generally C-shaped having a first end portion 140 which defines an opening 141 and four smaller holes 142; an arcuate intermediate portion 146; and a second end portion 148 defining two holes, only one of which, hole 149, is shown. The first end portion 140 is secured to the bottom movable stem 50 by means of opening 141 and the second end portion 148 is secured to second terminal means 64.

As can best be seen in FIG. 5, the flexible connector 84 itself consists of a stack of individual flexible sheets of a conducting material, such as copper or copper alloys. The sheets are preferably each about 0.005 inches (0.0127 cm) thick and each flexible connector is a stack of preferably fourteen sheets although only six sheets are shown in FIG. 5 for the sake of clarity. The flexible connector is constructed such that it is not only mechanically reliable but also flexible to accommodate the movement of the bottom movable stem 50.

The flexible sheets each have a pair of opposed major surfaces and are stacked together such that at least a portion of the major surfaces of each of the sheets contact at least a portion of the facing major surface of each adjacent sheet (except for the top surface of the top sheet and the bottom surface of the bottom sheet). The sheets are aided in being maintained in this stacking relationship by a plurality of spot welds, two of which are shown in FIGS. 4 and 5. The spot welds 156 and 158 are made on the edges of the flexible sheets. In this way, the flexible sheets stay together while maintaining the flexibility of the stack.

Figure 6:
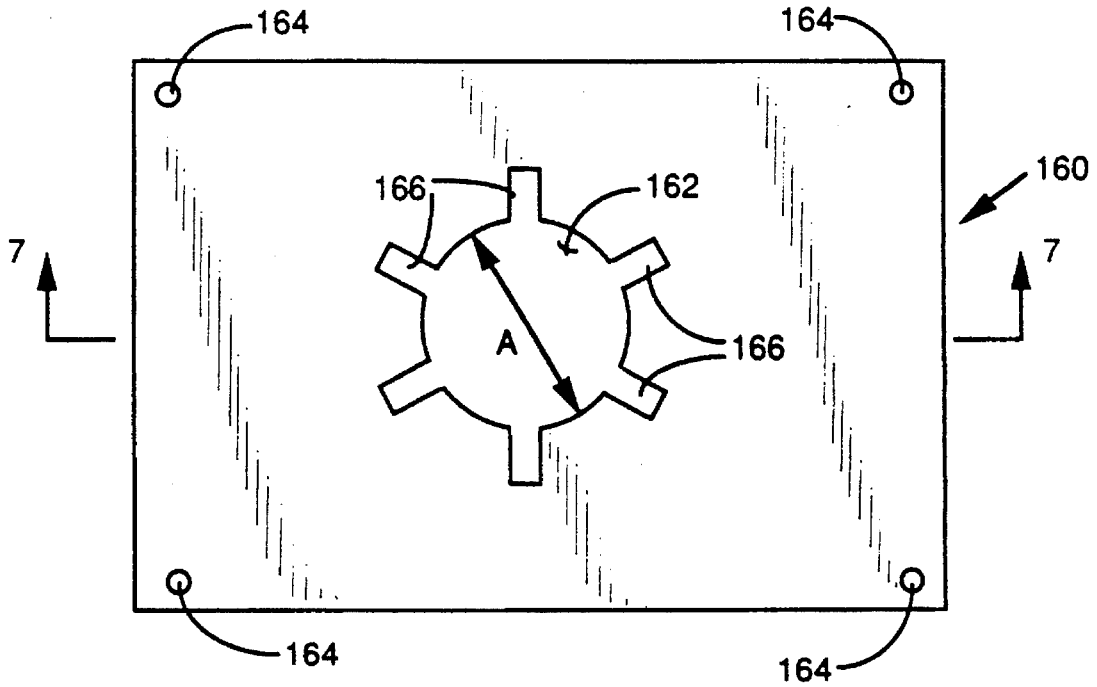
FIG. 6 is a top plan view of a contact plate.
Figure 7:
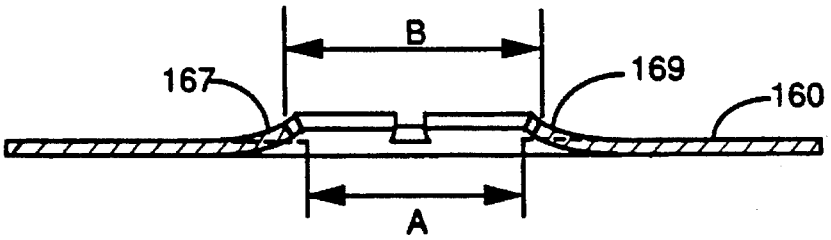
FIG. 7 is a cross-sectional view taken along line 7—7 of FIG. 6.

Referring now more particularly to FIGS. 6 and 7, a contact plate 160 in accordance with the invention will be explained in detail. The contact plate 160 is made of a conducting material, such as copper or copper alloy, and defines a movable stem opening 162 as well as four holes 164 for facilitating clamping of the flexible connector by the fastening means (FIG. 3). The contact plate 160 also defines slots 166 which extend radially outwardly from the movable stem opening. It will be appreciated that the movable stem opening diameter A shown in FIG. 6, is less than the diameter of the movable stem itself. In order to fit the contact plate 160 onto the movable stem 50, the radial slots 166 allow tabs, such as tabs 167 and 169 shown in FIG. 7 to form at a portion of the contact plate near the periphery of the movable stem. As can be seen in FIG. 7, the diameter B of the movable stem opening 162 is increased to approximately the diameter of the movable stem so when the tabs are deflected upwardly.

Referring back to FIG. 2, the contact plates are disposed on the movable stem 50 so that intimate multipoint contact is made with the movable stem 50. This will facilitate current flow into the contact plate and then through the contact plate and into the flexible connector.

Figure 8:
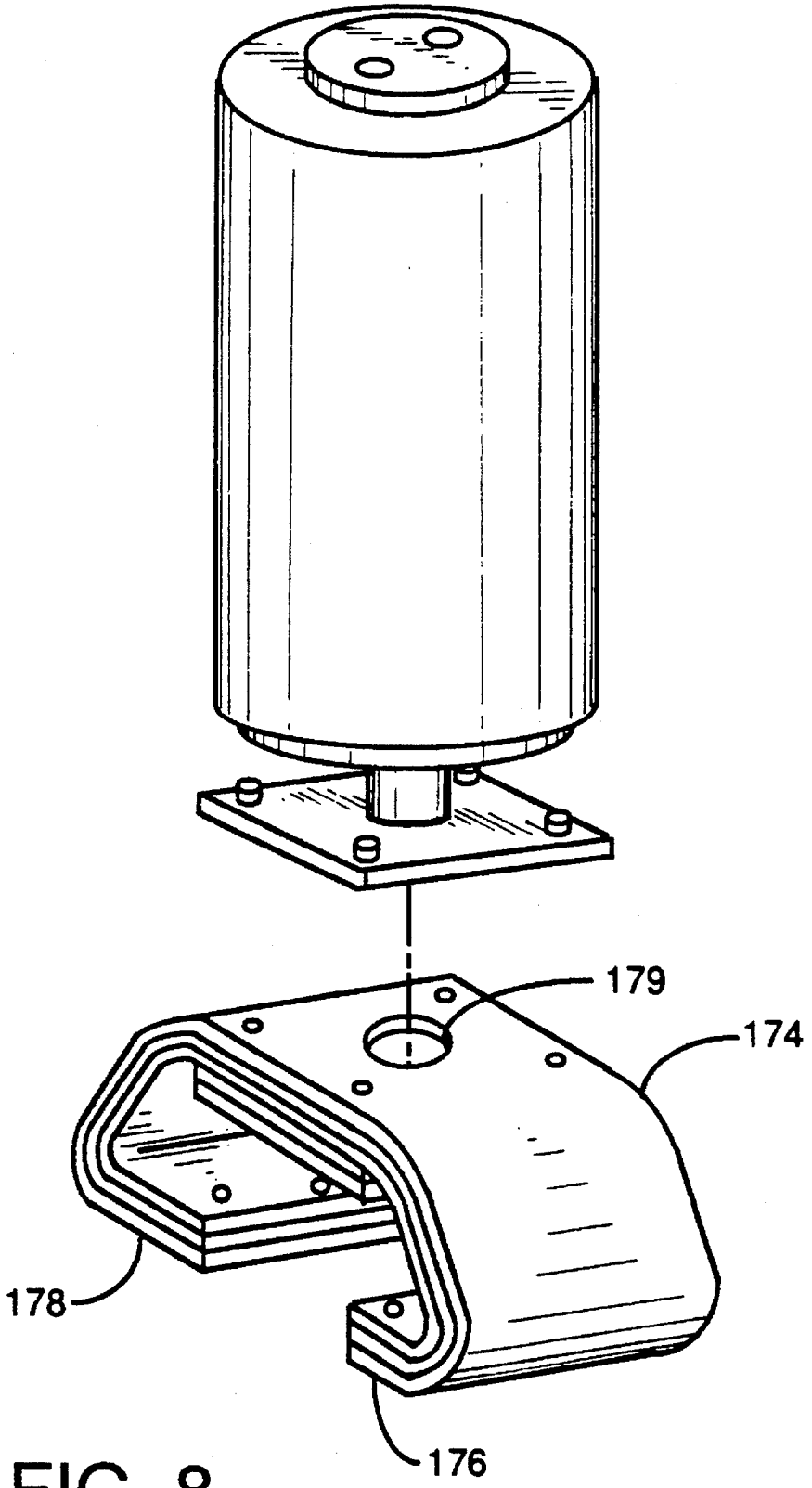
FIG. 8 is a perspective view of an alternate embodiment of an oval shaped flexible connector.

FIG. 8 shows an alternate embodiment of the flexible connector means 174 wherein the first end portion 176 and the second end portion 178 are connected to the second terminal and the movable stem is connected to an intermediate portion 179 of the flexible connector.

It will be appreciated that a flexible connector for a vacuum circuit interrupter has been disclosed that can be used for controlling and protecting electrical systems, apparatus and networks.

While specific embodiments of the invention have been disclosed, it will be appreciated by those skilled in the art that various modifications and alterations to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A circuit interrupter system, comprising:

circuit interrupter means including a fixed contact and a movable contact;

fixed electrical terminal means; and flexible connector means for connecting said movable contact with said fixed electrical terminal means, said flexible connector means comprising at least one stack of flexible sheets of a conducting material, each of said flexible sheets in said stack having a pair of opposed major surfaces with at least a portion of a major surface of one of said flexible sheets in said stack being in contact with at least a portion of a major surface of an adjacent one of said flexible sheets in said stack, said flexible sheets being constructed such that said flexible connector means can accommodate the movement of said movable contact, said stack being joined together by means at spaced apart zones near edges of said stack, whereby said flexible sheets stay together while maintaining the flexibility of said stack.

2. The flexible connector of claim 1, wherein said joining means is a plurality of spot welds.

3. A circuit interrupter system comprising:

circuit interrupter means including a fixed contact and a movable contact;

fixed electrical terminal means; and flexible connector means for connecting said movable contact with said fixed electrical terminal means, said flexible connector means comprising at least one stack of flexible sheets of a conducting material, each of said flexible sheets in said stack having a pair of opposed major surfaces with at least a portion of a major surface of one of said flexible sheets in said stack being in contact with at least a portion of a major surface of an adjacent one of said flexible sheets said stack, and said flexible sheets being constructed such that said flexible connector means can accommodate the movement of said movable contact, said flexible connector having a first end portion, a second end portion and an intermediate portion between said first and second end portions, said first and second end portions being connected to said fixed electrical terminal means and said movable contact being secured to said intermediate portion.

* * * * *